US006752875B2

(12) United States Patent
Kiesler et al.

(10) Patent No.: US 6,752,875 B2
(45) Date of Patent: Jun. 22, 2004

(54) METHODS AND SYSTEMS FOR WATER DETECTION IN A DISHWASHER

(75) Inventors: Jeffrey Thomas Kiesler, Louisville, KY (US); Arjan Johannes Hegeman, Lynn, MA (US); Michael Lee McIntyre, Cox's Creek, KY (US); Gregory Alan Meyer, Taylorsville, KY (US); Christopher Raymond Geisen, Louisville, KY (US); Gregory Owen Miller, Louisville, KY (US)

(73) Assignee: General Electric Company, Schenectady, NY (US)

( * ) Notice: Subject to any disclaimer, the term of this patent is extended or adjusted under 35 U.S.C. 154(b) by 105 days.

(21) Appl. No.: 09/930,711

(22) Filed: Aug. 15, 2001

(65) Prior Publication Data

US 2003/0034052 A1 Feb. 20, 2003

(51) Int. Cl.[7] ..... B08B 7/04
(52) U.S. Cl. ..... 134/18; 134/25.2; 134/57 D
(58) Field of Search ..... 134/18, 25.2, 57 D, 134/56 D

(56) References Cited

U.S. PATENT DOCUMENTS

| | | | | |
|---|---|---|---|---|
| 4,178,957 A | * | 12/1979 | Hoffman et al. | 137/387 |
| 5,669,983 A | | 9/1997 | Cooper et al. | |
| 5,797,409 A | * | 8/1998 | Cooper et al. | 134/18 |
| 5,803,985 A | * | 9/1998 | Alvord | 134/18 |
| 5,900,070 A | | 5/1999 | Jarvis et al. | |
| 5,909,743 A | | 6/1999 | Thies et al. | |
| 6,103,017 A | | 8/2000 | Thies et al. | |
| 6,182,674 B1 | | 2/2001 | Jozwiak et al. | |

* cited by examiner

*Primary Examiner*—Frankie L Stinson
*Assistant Examiner*—Saeed Chaudhry
(74) *Attorney, Agent, or Firm*—George L. Rideout, Jr.; Armstrong Teasdale LLP

(57) ABSTRACT

In one aspect, a dishwasher comprising a control mechanism coupled to a sensor for generating an output representative of whether sufficient water has flowed into the dishwasher during a fill operation is described. The dishwasher comprises a tub and a fluid circulation assembly for circulating water in the tub. The control mechanism is configured to determine whether terminate a current wash cycle based on a signal output by the sensor.

9 Claims, 4 Drawing Sheets

METHODS AND SYSTEMS FOR WATER DETECTION IN A DISHWASHER

BACKGROUND OF THE INVENTION

This invention relates generally to dishwashers, and, more particularly, to utilizing a turbidity sensor to facilitate avoiding component degradation.

Known dishwasher systems include a main pump assembly and a drain pump assembly for circulating and draining wash fluid within a wash chamber located in a cabinet housing. The main pump assembly feeds washing fluid to various spray arm assemblies for generating washing sprays or jets on dishwasher items loaded into one or more dishwasher racks disposed in the wash chamber. Fluid sprayed onto the dishwasher items is collected in a sump located in a lower portion of the wash chamber, and water entering the sump is filtered through one or more coarse filters to remove soil and sediment from the washing fluid.

In the event that no or insufficient water flow exists in the dishwasher when a water valve between a water source and the main pump assembly is open, components of the dishwasher can degrade as a result of energizing the pump. For example, the pump seal, the lower spray arm, and the tub itself can degrade in the event that the pump is energized when no, or insufficient, water is flowing to the dishwasher.

BRIEF SUMMARY OF THE INVENTION

In one aspect, a dishwasher comprising a control mechanism coupled to a sensor for generating an output representative of an amount of water in the dishwasher water is provided. The dishwasher comprises a tub and a fluid circulation assembly for circulating water in the tub. The control mechanism is configured to determine whether sufficient water is in the tub and whether to terminate a current was cycle if insufficient water is not present in the tub.

In another aspect, a method for controlling operation of a dishwasher is provided. The dishwasher comprises a tub, a sensor in flow communication with the tub, and a fluid circulation assembly for circulating water in the tub. The method comprising the steps of determining whether sufficient water is in the tub based on an output signal from the sensor, and if insufficient water is in the tub, terminating a current wash cycle.

In yet another aspect, a kit comprising a turbidity sensor for coupling to a tub of a dishwasher is provided. The sensor is configured to couple to a control mechanism comprising a processor programmed to determine whether sufficient water is in the tub based on an output of the sensor.

DETAILED DESCRIPTION OF THE INVENTION

Figure 1:
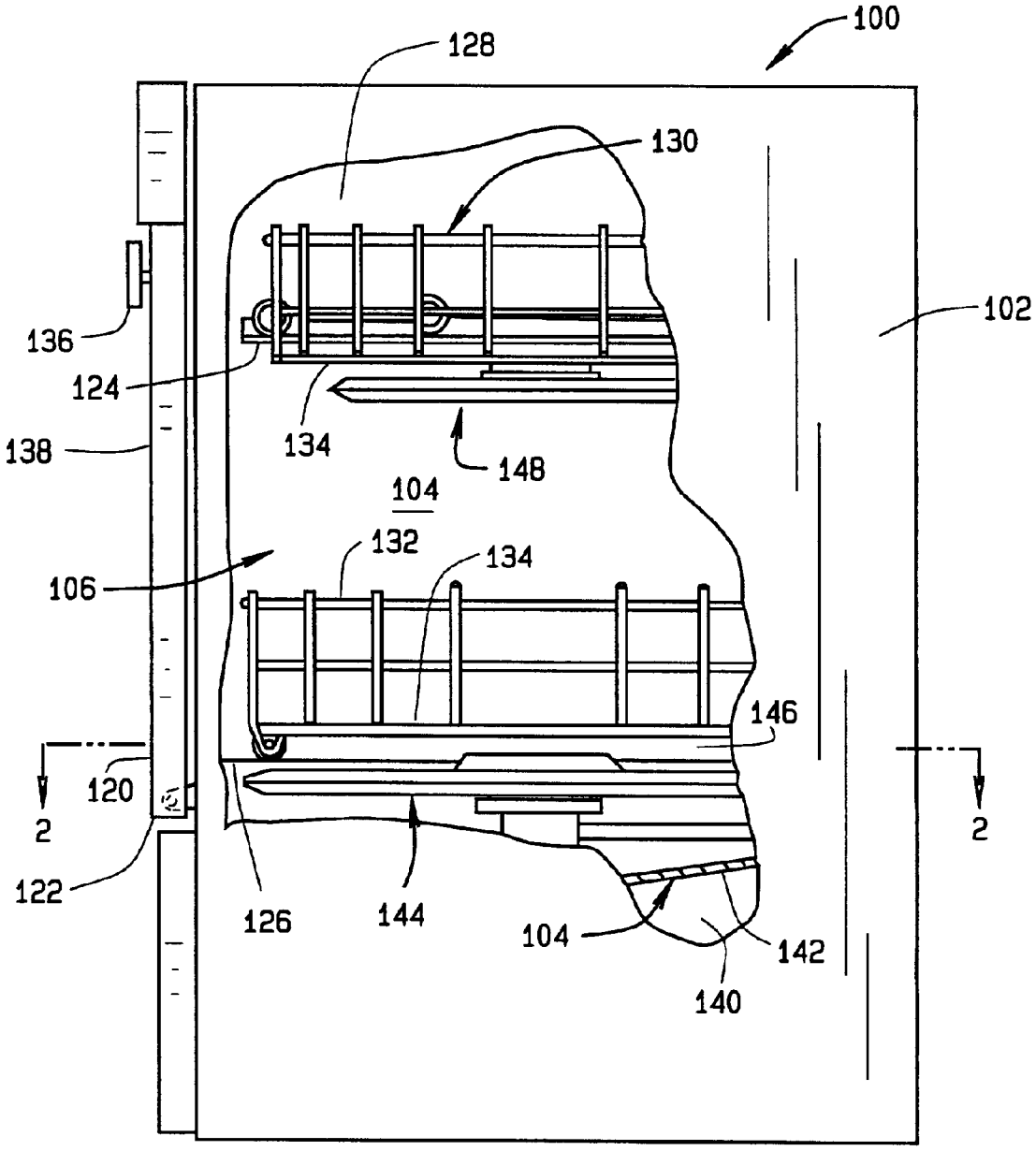
FIG. 1 a side elevational view of an example dishwasher system partially broken away.

FIG. 1 is a side elevational view of an exemplary domestic dishwasher system 100 partially broken away, and in which the present invention may be practiced. It is contemplated, however, that the invention may be practiced in other types of dishwashers and dishwasher systems other than just dishwasher system 100 described and illustrated herein. Accordingly, the following description is for illustrative purposes only, and the invention is not limited to use in a particular type of dishwasher system, such as dishwasher system 100.

Dishwasher 100 includes a cabinet 102 having a tub 104 therein and forming a wash chamber 106. Tub 104 includes a front opening (not shown in FIG. 1) and a door 120 hinged at its bottom 122 for movement between a normally closed vertical position (shown in FIG. 1) wherein wash chamber is sealed shut for washing operation, and a horizontal open position (not shown) for loading and unloading of dishwasher contents.

Upper and lower guide rails 124, 126 are mounted on tub side walls 128 and accommodate upper and lower roller-equipped racks 130, 132, respectively. Each of upper and lower racks 130, 132 is fabricated from known materials into lattice structures including a plurality of elongate members 134, and each rack 130, 132 is adapted for movement between an extended loading position (not shown) in which at least a portion of the rack is positioned outside wash chamber 106, and a retracted position (shown in FIG. 1) in which the rack is located inside wash chamber 106. Conventionally, a silverware basket (not shown) is removably attached to lower rack 132 for placement of silverware, utensils, and the like that are too small to be accommodated by upper and lower racks 130, 132.

A control input selector 136 is mounted at a convenient location on an outer face 138 of door 120 and is coupled to known control circuitry (not shown) and control mechanisms (not shown) for operating a fluid circulation assembly (not shown in FIG. 1) for circulating water and dishwasher fluid in dishwasher tub 104. The fluid circulation assembly is located in a machinery compartment 140 located below a bottom sump portion 142 of tub 104, and its construction and operation is explained in detail below.

A lower spray-arm-assembly 144 is rotatably mounted within a lower region 146 of wash chamber 106 and above tub sump portion 142 so as to rotate in relatively close proximity to lower rack 132. A mid-level spray-arm assembly 148 is located in an upper region of wash chamber 106 in close proximity to upper rack 130 and at a sufficient height above lower rack 132 to accommodate items such as a dish or platter (not shown) that is expected to be placed in lower rack 132. In a further embodiment, an upper spray arm assembly (not shown) is located above upper rack 130 at a sufficient height to accommodate a tallest item expected to be placed in upper rack 130, such as a glass (not shown) of a selected height.

Lower and mid-level spray-arm assemblies 144, 148 and the upper spray arm assembly are fed by the fluid circulation assembly, and each spray-arm assembly includes an arrangement of discharge ports or orifices for directing washing liquid onto dishes located in upper and lower racks 130, 132, respectively. The arrangement of the discharge ports in at least lower spray-arm assembly 144 results in a rotational force as washing fluid flows through the discharge ports. The resultant rotation of lower spray-arm assembly 144 provides coverage of dishes and other dishwasher contents with a washing spray. In various alternative embodiments, mid-level spray arm 148 and/or the upper spray arm are also rotatably mounted and configured to generate a swirling spray pattern above and below upper rack 130 when the fluid circulation assembly is activated.

Figure 2:
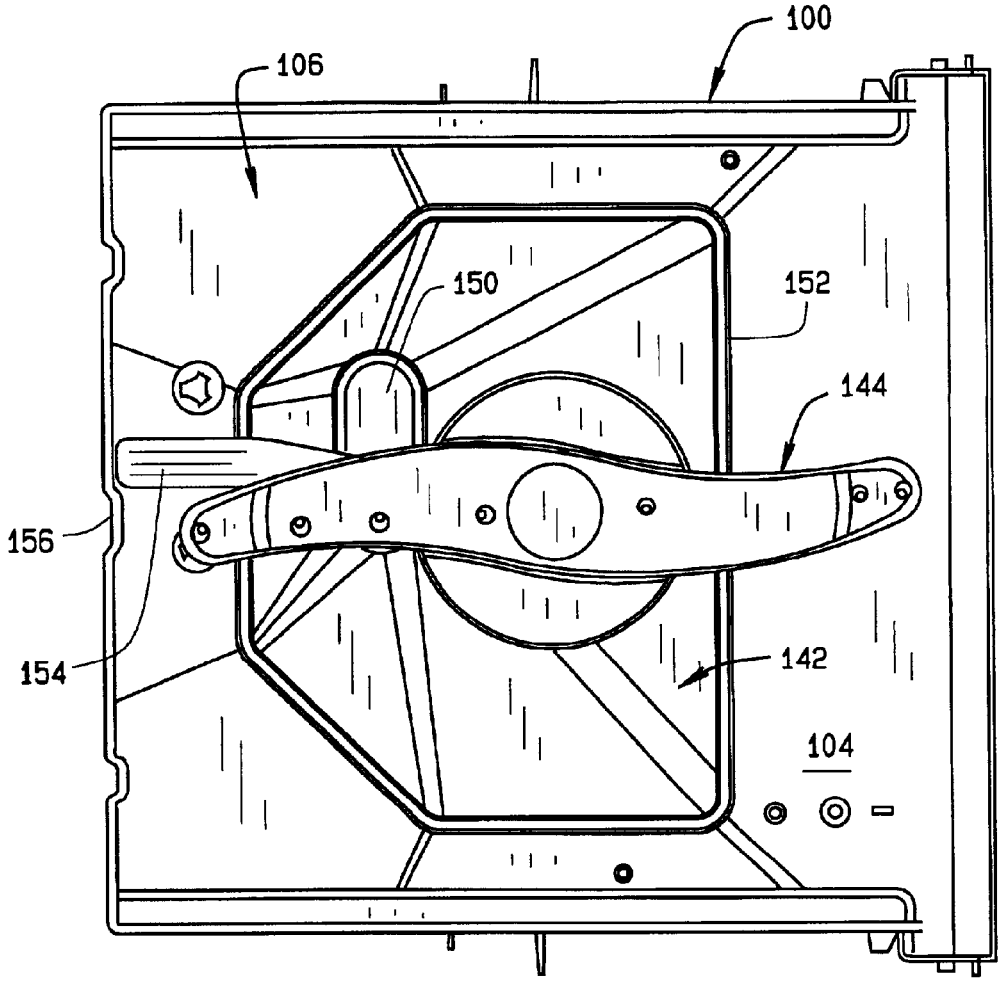
FIG. 2 is a top plan view of a portion of the dishwasher system shown in FIG. 1 along line 2—2.

FIG. 2 is a top plan view of a dishwasher system 100 just above lower spray arm assembly 144. Tub 104 is generally downwardly sloped beneath lower spray arm assembly 144 toward tub sump portion 142, and tub sump portion is generally downwardly sloped toward a sump 150 in flow communication with the fluid circulation assembly (not shown in FIG. 2). Tub sump portion 142 includes a six-sided outer perimeter 152. Lower spray arm assembly is substantially centered within tub 104 and wash chamber 106, off-centered with respect to tub sump portion 142, and positioned above tub 104 and tub sump portion 142 to facilitate free rotation of spray arm 144.

Tub 104 and tub sump portion 142 are downwardly sloped toward sump 150 so that water sprayed from lower spray arm assembly 144, mid-level spray arm assembly 148 (shown in FIG. 1) and the upper spray arm assembly (not shown) is collected in tub sump portion 142 and directed toward sump 150 for filtering and re-circulation, as explained below, during a dishwasher system wash cycle. In addition, a conduit 154 extends beneath lower spray arm assembly 144 and is in flow communication with the fluid circulation assembly. Conduit 154 extends to a back wall 156 of wash chamber 106, and upward along back wall 156 for feeding wash fluid to mid-level spray arm assembly 148 and the upper spray arm assembly.

Figure 3:
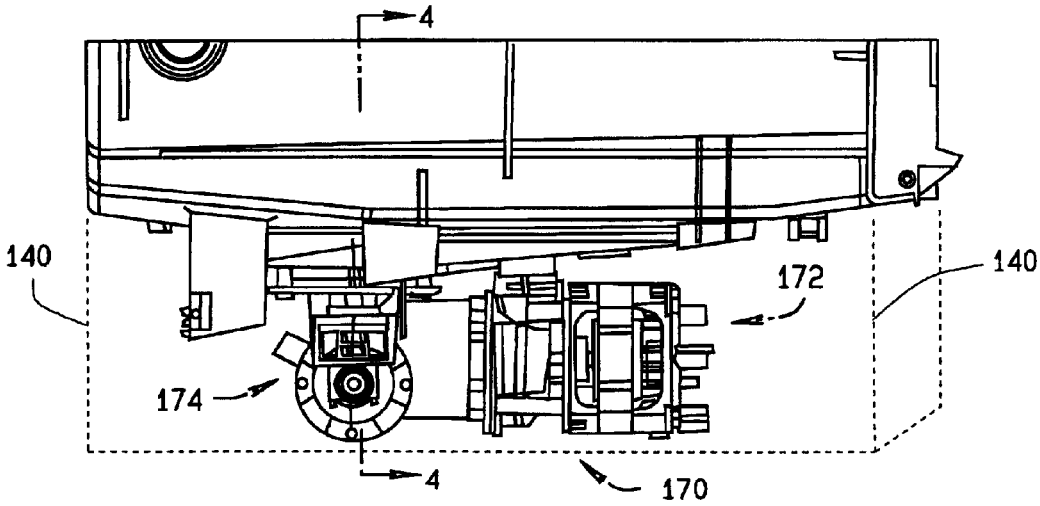
FIG. 3 is a partial side elevational view of the portion of the dishwasher system shown in FIG. 2.

FIG. 3 illustrates fluid circulation assembly 170 located below wash chamber 106 (shown in FIGS. 1 and 2) in machinery compartment 140 (shown in phantom in FIG. 3). Fluid circulation assembly 170 includes a main pump assembly 172 established in flow communication a building plumbing system water supply pipe (not shown) and a drain pump assembly 174 in fluid communication with sump 150 (shown in FIG. 2) and a building plumbing system drain pipe (not shown).

Figure 4:
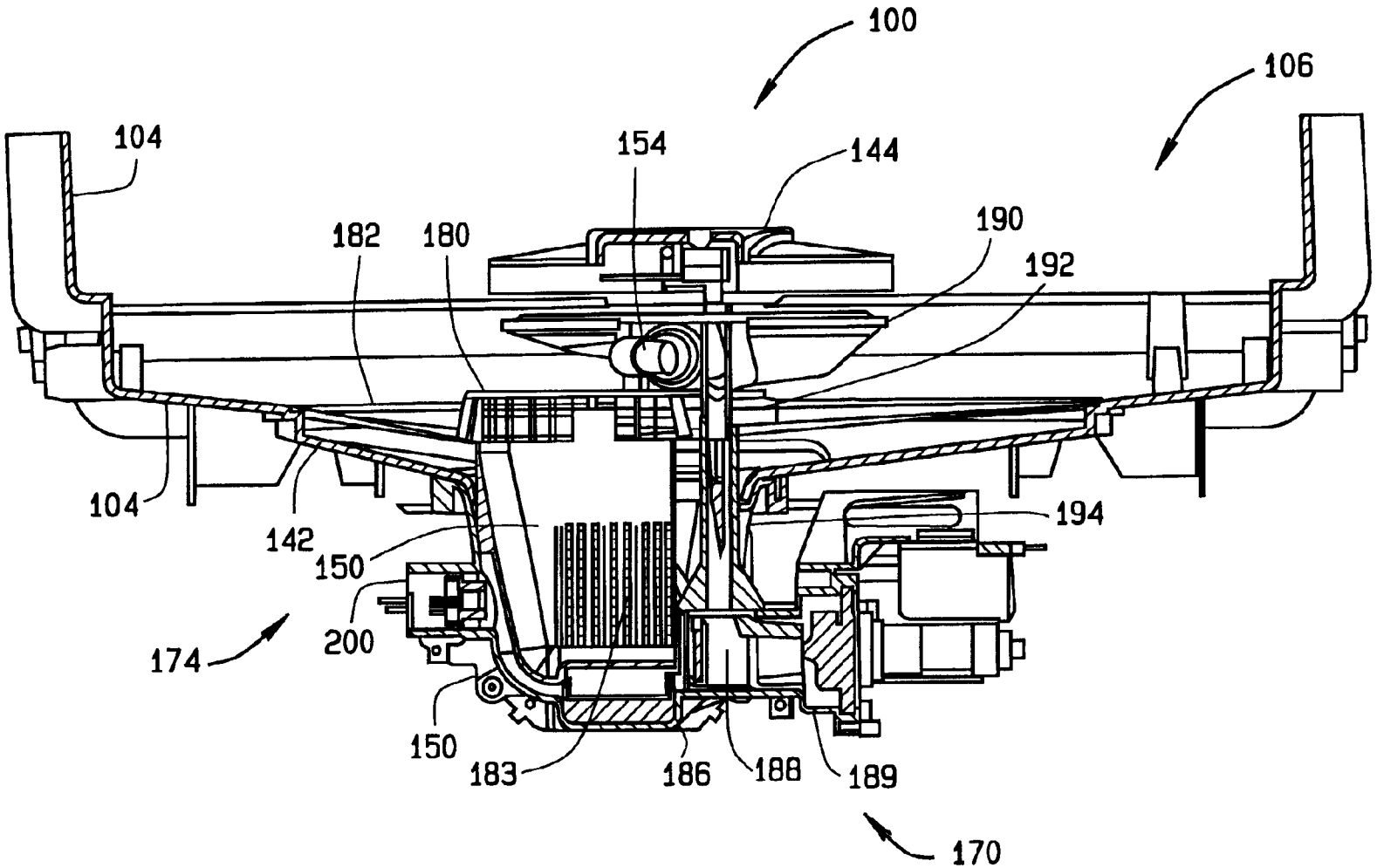
FIG. 4 is a cross sectional schematic view of the portion of the dishwasher system shown in FIG. 3 along line 4—4.

FIG. 4 is a cross sectional schematic view of dishwasher system 100, and more specifically of fluid circulating assembly 170 through drain pump assembly 174. Tub 104 is downwardly sloped toward tub sump portion 142, and tub sump portion is downwardly sloped toward sump 150. As wash fluid is pumped through lower spray arm assembly 144, and further delivered to mid-level spray arm assembly 148 (shown in FIG. 1) and the upper spray arm assembly (not shown), washing sprays are generated in wash chamber 106, and wash fluid collects in sump 150.

Sump 150 includes a cover 180 to prevent larger objects from entering sump 150, such as a piece of silverware or another dishwasher item that is dropped beneath lower rack 132 (shown in FIG. 1). A course filter 182 is located to filter wash fluid for sediment and particles of a predetermined size before flowing into sump 150 over tub sump portion 142. Wash fluid flowing through cover 180 flows through coarse inlet filter 183 into sump 150.

A drain check valve 186 is established in flow communication with sump 150 and opens or closes flow communication between sump 150 and a drain pump inlet 188. A drain pump 189 is in flow communication with drain pump inlet 188 and includes an electric motor for pumping fluid at inlet 188 to a pump discharge (not shown in FIG. 4) and ultimately to a building plumbing system drain (not shown). When drain pump is energized, a negative pressure is created in drain pump inlet 188 and drain check valve 186 is opened, allowing fluid in sump 150 to flow into fluid pump inlet 188 and be discharged from fluid circulation assembly 170.

A fine filter assembly 190 is located below lower spray arm assembly and above tub sump portion 142. As wash fluid is pumped into lower spray arm 144 to generate a washing spray in wash chamber 106, wash fluid is also pumped into fine filter assembly 190 to filter wash fluid sediment and particles of a smaller size than coarse filters 182 and 183. Sediment and particles incapable of passing through fine filter assembly 190 are collected in fine filter assembly 190 and placed in flow communication with a fine filter drain tube 192 received in a fine filter drain docking member 194, which is, in turn, in flow communication with drain pump inlet 188. Thus, when pressure in fine filter assembly 190 exceeds a predetermined threshold, thereby indicating that fine filter assembly is clogged with sediment, drain pump 189 can be activated to drain fine filter assembly. Down jets (not shown) of lower spray arm assembly 144 spray fluid onto fine filter assembly 190 to clean fine filter assembly during purging or draining of fine filter assembly 190.

Figure 5:
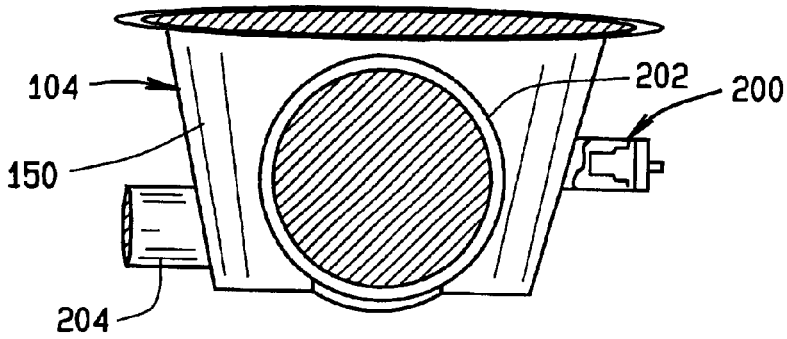
FIG. 5 is a schematic illustration of a sump and a turbidity sensor coupled thereto.

FIG. 5 is a schematic illustration of sump portion 150 of tub 104 and a turbidity sensor 200 coupled thereto. Sensor 200 is mounted in sump portion 150 and located so that sensor 200 is above the water level after the dishwasher has drained. A first outlet 202 of sump portion 150 is in flow communication with drain pump inlet 188 (FIG. 4) and a second outlet 204 of sump portion 150 is in flow communication with an auxiliary pump (not shown).

Turbidity sensor 200 is coupled to the dishwasher control mechanism, and sensor 200 generates an output signal representative of a water level and of sediment in tub 104. The control mechanism comprises, in one embodiment, a processor configured for determining whether sufficient water is present in the tub, as described below in more detail. The term configured, as used herein, means that the processor is programmed or otherwise controlled to perform the functions described below. Turbidity sensors are commercially available. An example turbidity sensor is Model TS15, commercially available from Elektromanufaktur Zangenstein Hanauer GmbH & Co., KgaA Siemensstrabe 1, Nabburg D-92507.

Generally, turbidity sensor 200 generates a signal representative of the amount of water and the soil level in the water by sensing light transmittance from a light emitting diode (LED) at a known wavelength. For example, when sensor 200 is fully submerged in static or smooth dynamic (i.e., wihtout bubbles) water, the output signal from sensor 200 is stable. Any particles in the water inhibit light transmittance. Therefore, as the soil level in the water rises, the voltage level of the signal output by sensor 200 decreases. Air bubbles also inhibit light transmittance.

Figure 6:
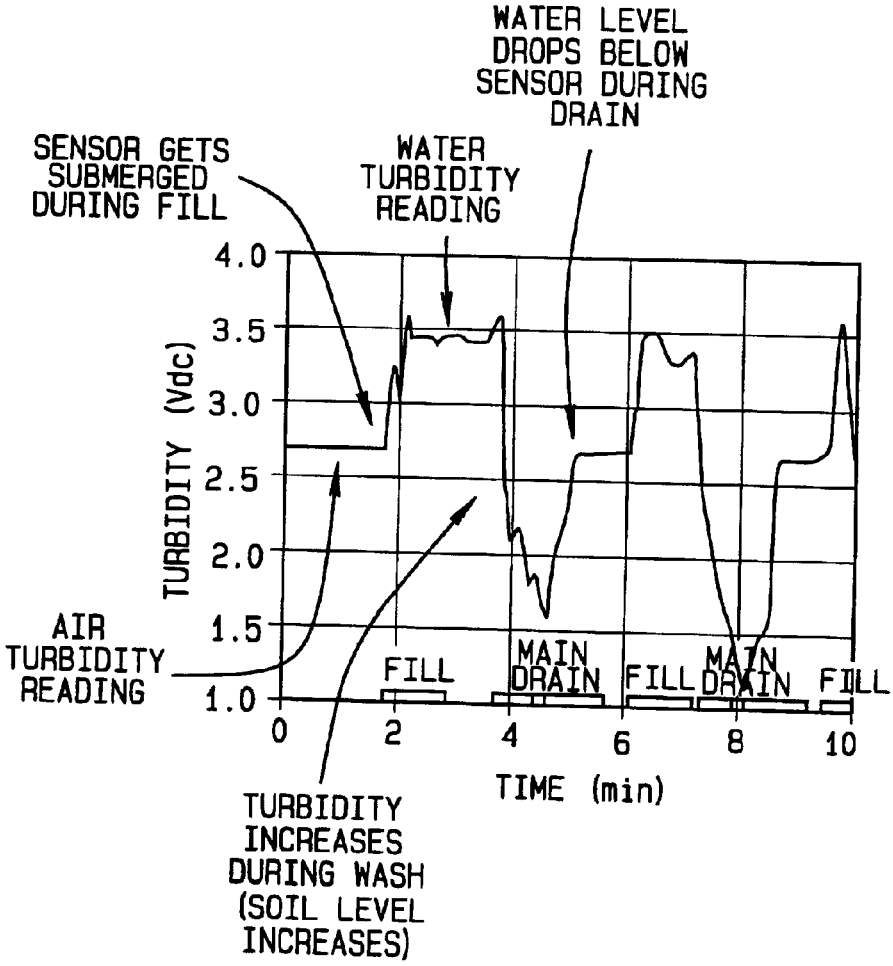
FIG. 6 is a graphical representation of an example signal output by the turbidity sensor shown in FIG. 5 during a wash cycle.

FIG. 6 is a graphical representation of an example signal output by sensor 200 during a wash cycle. The x-axis is time, and the y-axis is the magnitude of turbidity as measured by the voltage signal output by sensor 200.

As shown in FIG. 6 in the example wash cycle, prior to a first fill operation, the sensor output signal is generated based on air being present in the tub. During the fill operation, the sensor output signal increases due to sensor 200 getting submerged by water. Once sensor 200 is fully submerged, then the output signal of sensor 200 stabilizes.

During circulation, however, the sensor output signal decreases due to the increase of particles that have been rinsed off the dishes into the water. The water is then pumped out of the dishwasher during a drain operation. As water is pumped out of the dishwasher, the water level drops below sensor 200 and the sensor output signal is generated based on sensor 200 being in air. As before, during a fill operation, the sensor signal output signal increases due to sensor 200 being submerged by water.

In the event that the change in the sensor output signal as sensor 200 transitions from being in air (e.g., just before the fill operation) and submerged in water is not detected by the control unit when the water valve is open, then control unit terminates the wash cycle. The wash cycle is terminated by the control unit because such a condition indicates that no, or insufficient, water is present in the dishwasher.

More specifically, once the water valve opens so that water is flowing into the dishwasher, sensor 200 should become submerged in water. The amount of time required for sensor 200 to become submerged depends, of course, on the size of the dishwasher and the rate at which water flows through the valve. The amount of time can be determined empirically, for example. In any event, after a drain operation and shortly after initiation of a fill operation, the sensor output signal should transition from the signal generated when sensor 200 is in air to the signal generated when sensor 200 is in water. If such transition does not occur within the predetermined period of time, then such a condition indicates that no, or insufficient, water is flowing in the dishwasher. To facilitate avoiding damage to dishwasher components, the control mechanism terminates the wash cycle under such conditions.

The above described control facilitates avoiding component degradation due to a lack of water being present in the dishwasher. As explained above, utilizing a turbidity sensor as described herein is not limited to practice with a specific dishwasher such as the three level dishwasher described above. A turbidity sensor as described above can be utilized in many different types and models of dishwashers.

While the invention has been described in terms of various specific embodiments, those skilled in the art will recognize that the invention can be practiced with modification within the spirit and scope of the claims.

What is claimed is:

1. A dishwasher comprising:

a tub;

at least one filter for filtering water in said tub;

a sensor in flow communication with said tub;

a fluid circulation assembly for circulating water in said tub; and a control mechanism coupled to said sensor and to said fluid circulation assembly, said control mechanism comprising a processor programmed to determine whether a sufficient amount of water flows into said tub during a fill operation based on a signal output by said sensor and to terminate a wash cycle when said control mechanism determines that a sufficient amount of water has not flowed into said tub during said fill operation based on said signal output by said sensor.

2. A dishwasher according to claim 1 wherein to determine whether a sufficient amount of water has flowed into said tub, said control mechanism:

determines whether an output voltage signal from said sensor has transitioned from a first condition to a second condition.

3. A dishwasher according to claim 2 wherein said first condition is that said sensor generates an output signal representative of said sensor being in air, and said second condition is that said sensor generates an output signal representative of said sensor being in water.

4. A dishwasher according to claim 1 wherein said tub comprises a sump portion, and wherein said sensor is coupled to said tub at said sump portion.

5. A dishwasher according to claim 1 wherein said sensor comprises a turbidity sensor.

6. A method for controlling operation of a dishwasher, the dishwasher comprising a tub, at least one filter for filtering water in the tub, a sensor in flow communication with the tub, and a fluid circulation assembly for circulating water in the tub, said method comprising the steps of:

determining whether a sufficient amount of water has flowed into the tub during a fill operation, and if an insufficient amount of water has flowed into the tub during the fill operation, terminating a current wash cycle.

7. A method according to claim 6 wherein determining whether the sufficient amount of water has flowed into the tub comprises the step of determining whether an output voltage signal from the sensor has transitioned from a first condition to a second condition.

8. A method according to claim 7 wherein said first condition is that the sensor generates an output signal representative of the sensor being in air, and the second condition is that the sensor generates an output signal representative of the sensor being in water.

9. A method according to claim 6 wherein the sensor is a turbidity sensor.

* * * * *

UNITED STATES PATENT AND TRADEMARK OFFICE

CERTIFICATE OF CORRECTION

PATENT NO. : 6,752,875 B2
DATED : June 22, 2004
INVENTOR(S) : Kiesler et al.

It is certified that error appears in the above-identified patent and that said Letters Patent is hereby corrected as shown below:

Title page,
Item [75], Inventors, after "Arjan Johannes Hegeman" delete "Lynn, MA" and insert therefor -- Pembroke, NH --.

Signed and Sealed this

Twenty-ninth Day of November, 2005

JON W. DUDAS
*Director of the United States Patent and Trademark Office*